US005502901A

United States Patent [19]

Brown

[11] Patent Number: 5,502,901

[45] Date of Patent: Apr. 2, 1996

[54] SHOCK REDUCING FOOTWEAR AND METHOD OF MANUFACTURE

[76] Inventor: Jeffrey W. Brown, 736 Windimere Ct., San Diego, Calif. 92109

[21] Appl. No.: 240,882

[22] Filed: May 10, 1994

Related U.S. Application Data

[63] Continuation-in-part of Ser. No. 876,777, Apr. 28, 1992, which is a continuation-in-part of Ser. No. 673,470, May 7, 1991, abandoned.

[51] Int. Cl.[6] ..... A43B 13/18; A43B 13/28

[52] U.S. Cl. ..... 36/28; 36/7.8; 36/27; 36/29; 36/37; 36/38; 36/35 R

[58] Field of Search ..... 36/114, 7.8, 25 R, 36/27, 28, 29, 37, 38, 35 R, 35 B, 3 R, 3 B

[56] References Cited

U.S. PATENT DOCUMENTS

| | | | |
|---|---|---|---|
| 819,449 | 5/1906 | Otterstedt | 36/3 B |
| 1,099,180 | 6/1914 | Karacsonyi | 36/38 |
| 1,218,391 | 3/1917 | Gay | 36/38 |
| 1,261,488 | 4/1918 | Cerar et al. | 36/38 |
| 1,506,975 | 9/1924 | Cooney | 36/29 |
| 2,004,906 | 6/1935 | Simister | 36/29 |
| 2,444,865 | 7/1948 | Warrington | 36/38 |
| 2,555,654 | 6/1951 | Ostrom | 36/38 |
| 2,669,038 | 2/1954 | Werth | 36/38 |
| 3,044,190 | 7/1962 | Urbany | 36/29 |
| 3,180,039 | 4/1965 | Burns, Jr. | 36/3 B |
| 4,457,084 | 7/1984 | Horibata | 36/28 |
| 4,520,138 | 5/1985 | Himes | 521/91 |
| 4,753,021 | 6/1988 | Cohen | 36/28 |
| 4,760,651 | 8/1988 | Pon-Tzu | 36/3 B |

FOREIGN PATENT DOCUMENTS

| | | | |
|---|---|---|---|
| 618719 | 8/1935 | Germany | 36/38 |
| 1161073 | 6/1985 | U.S.S.R. | 36/28 |
| 664554 | 1/1952 | United Kingdom | 36/38 |

*Primary Examiner*—Paul T. Sewell
*Assistant Examiner*—Marie Denise Patterson
*Attorney, Agent, or Firm*—Shoemaker and Mattare, Ltd.

[57] ABSTRACT

An article of footwear has an outsole with a cavity in the heel region in which a cushioning insert is installed to cushion impacts and provide added lift to the wearer. The heel region of the outsole projects outwardly beyond the periphery of the heel region of the shoe upper to form a projecting peripheral rim. The cavity has an upper wall and a lower wall and a plurality of springs extend between the upper and lower walls at spaced intervals around the peripheral rim. Opposing magnets are mounted in the upper and lower walls in a central region of the cavity with their like poles facing one another to provide a magnetic biassing force which augments the spring load.

23 Claims, 3 Drawing Sheets

SHOCK REDUCING FOOTWEAR AND METHOD OF MANUFACTURE

CROSS-REFERENCES TO RELATED APPLICATIONS

This application is a Continuation-In-Part of pending application Ser. No. 07/876,777 filed Apr. 28, 1992, which was a Continuation-In-Part of application Ser. No. 07/673,470 filed May 7, 1991 (now abandoned).

BACKGROUND OF THE INVENTION

This invention relates generally to footwear and is particularly concerned with footwear having shock absorbing or cushioning properties, and to methods of manufacturing such footwear.

Numerous shoe and other footwear designs have been proposed in the past for absorbing shock and adding lift, particularly in the athletic shoe field. U.S. Pat. No. 4,817,304 of Parker et al. describes footwear with a cushioning sole structure in which a sealed internal member in the sole is inflated with gas to form a resilient insert in the heel region of the shoe. Various shoe structures have been proposed in the past in which springs are embedded in the shoe sole in the heel region or over the entire sole, as shown, for example, in U.S. Pat. No. 5,138,776 of Levin, U.S. Pat. No. 4,566,206 of Weber, and U.S. Pat. No. 4,592,153 of Jacinto. Some of these structures are relatively bulky and heavy, and could not effectively be manufactured.

SUMMARY OF THE INVENTION

It is an object of the present invention to provide new and improved items of footwear which have improved shock absorbing properties and which also add lift and propulsion to the foot of a wearer when walking or running.

According to the present invention, footwear is provided which comprises an upper shaped to conform to the upper contour of a wearer's foot and including a heel portion for conforming to a wearer's heel, a sole member attached to the undersurface of the upper for supporting the sole of a wearer's foot, the sole member having a heel region, an arch region and a toe region, the heel region of the sole member having a rim portion projecting outside the periphery of the heel portion of the upper, the sole member having a cavity extending across at least the heel region, the cavity having an upper wall and a lower wall, and a plurality of springs mounted between the upper and lower wall at spaced intervals around the rim portion of the heel region.

A number of advantages are achieved by positioning the cushioning springs outside the wearer's heel. Firstly, the enlarged heel region of the sole member adds increased surface area for shock absorption at the heel, which is the first region of the shoe or other article of footwear to strike the ground when walking, for example. The increased heel area also increases stability. Since no springs are positioned directly beneath a wearer's foot, the risk of harmful shock or uncomfortable spring pressure points under the heel is prevented.

Preferably, magnet configurations are mounted on the upper and lower wall of the cavity in a central region of the heel in magnetic opposition so that they are magnetically repelled from one another and tend to hold the cavity open. The magnets act in conjunction with the springs to dissipate shock and further add lift and propulsion to the wearer's foot in motion. The magnets are preferably high strength, high intensity magnets placed with like poles opposing one another, mounted on a thin lightweight backing metal.

The springs and magnets together are designed to support an air-flux gap within the sole member at all times. This permits continuous and more effective shock dissipation than the case where a gap is closed, solid or absent under load. The size and number of springs used will be dependent on the shoe size and the weight of the wearer, and the springs will be designed such that they will not be fully compressed under load during normal motion of the wearer. In other words, a person will put between 2 and 3 times their weight on their foot during motion. If a person's weight is W and the number of springs is n, each individual spring must be able to support a weight or load of 3W/n without becoming fully compressed. Thus, springs having different load characteristics will be used for individuals of different weights, or a greater number of springs may be used for heavier individuals. Since the springs are never fully compressed, there will always be some cushioning of the foot while the person is in motion.

The springs and magnets work in conjunction to absorb and dissipate load or shock as the foot hits the ground, and subsequently as the person rotates from the heel to the ball of the foot, both the springs and the magnets will bias the opposing walls of the cavity apart, giving lift or propulsion to the shoe wearer.

In a preferred embodiment of the invention, the springs and magnets are mounted in upper and lower inserts which are installed in the heel cavity and optionally also in the ball of the foot region during manufacture. The insert has an upper piece for securing to the upper wall of the cavity and a lower piece for securing to the lower wall of the outsole. The upper and lower pieces have opposing inner faces each having a recess for mounting a respective one of the magnet configurations in opposition to the magnet configuration in the other piece. Preferably, a first set of projecting, tubular bosses or pegs extend at spaced intervals from one of the inner faces around its perimeter, while a second set of projecting tubular bosses of greater diameter than the first set project at spaced intervals around the perimeter of the other inner face so as to mate with the bosses of the first set when the insert is installed in the cavity. Each telescopically engaging pair of bosses forms a canister for holding a respective one of the springs.

One or more additional cavities may be provided elsewhere in the sole member and springs and/or magnets may be inserted in the additional cavities for increased shock absorption and cushioning if required.

The sole may be a horizontally split sole molded as an upper part and a lower part which are subsequently bonded or over molded together so as to leave one or more cavities or gaps of the desired dimensions in various locations, such as the heel portion, arch or ball portion of the sole.

The shock absorbing insert of this invention may be used in any type of footwear, such as sports/athletic shoes, boots, casual shoes, work shoes, children's shoes, orthopedic shoes, sandals and the like. It will significantly reduce shock to the body while walking, running or in other types of foot motion, and will add lift and propulsion, thereby reducing fatigue.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
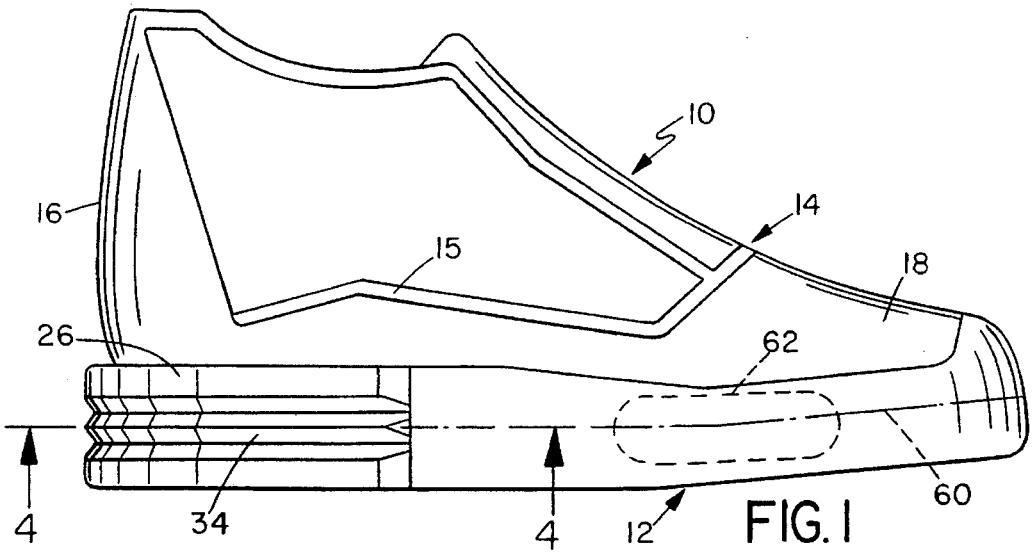
FIG. 1 is a side elevation view of a shoe having an embedded shock reducing insert assembly according to a first embodiment of the present invention.

FIGS. 1–4 and 7 of the drawings illustrate a shoe 10 incorporating a shock reducing sole assembly 12 according to a first embodiment of the present invention. The shoe 10 illustrated in the drawings is of the sports or athletic type, but it will be understood that the shock reducing sole assembly of this invention may alternatively be incorporated in other types and styles of footwear including boots, casual shoes, sandals, work shoes and orthopedic shoes.

Figure 2:
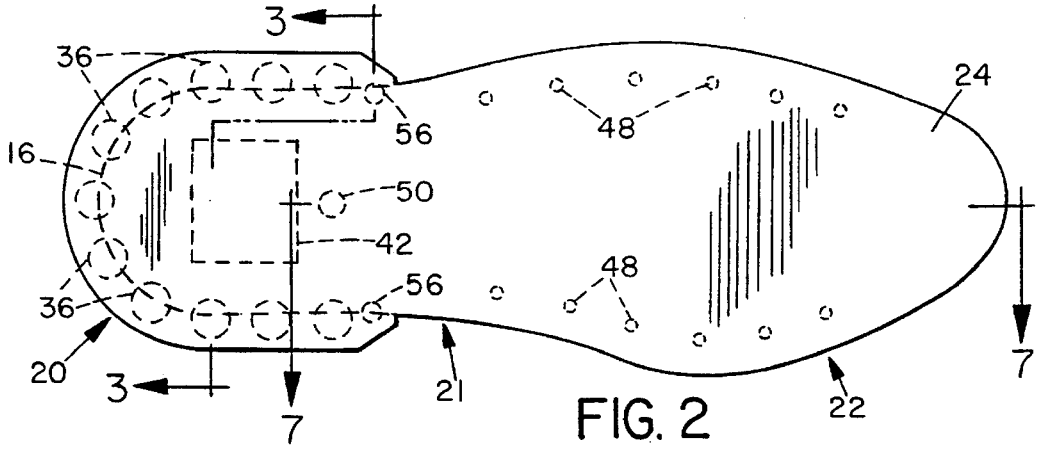
FIG. 2 is a bottom plan view of the undersurface of the sole of the shoe.
Figure 3:
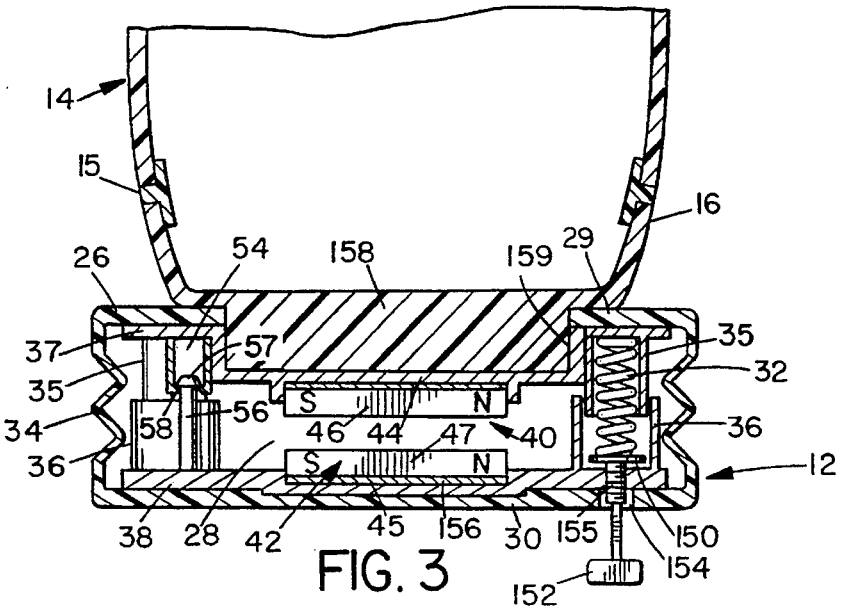
FIG. 3 is a cross-section on the lines 3—3 of FIG. 2.

The shoe 10 comprises an upper 14 shaped to enclose the upper surface of a wearer's foot and including a heel-enclosing region 16 and a toe-enclosing region 18, and the sole assembly 12 which covers the lower surface of the molded composite uppers. The upper may be formed in several pieces which are joined together along seams via elongate attachment tongues 15 which are of T-shaped cross-section, as illustrated in FIG. 3, rather than by more conventional overlap stitching. The tongues or joints 15 may be attached to the composite uppers pieces by glue, sonic welding, overmolding, stitching, pop rivets, staples or the like. As best illustrated in FIG. 2, the sole of the shoe includes a heel region 20, arch region 21, ball of the foot region 22, and toe region 24. The heel region 20 has a rim 26 which projects outwardly from the outer periphery of the upper heel region 16 around the peripheral edge of the heel, as illustrated in FIGS. 2 and 3.

Figure 4:
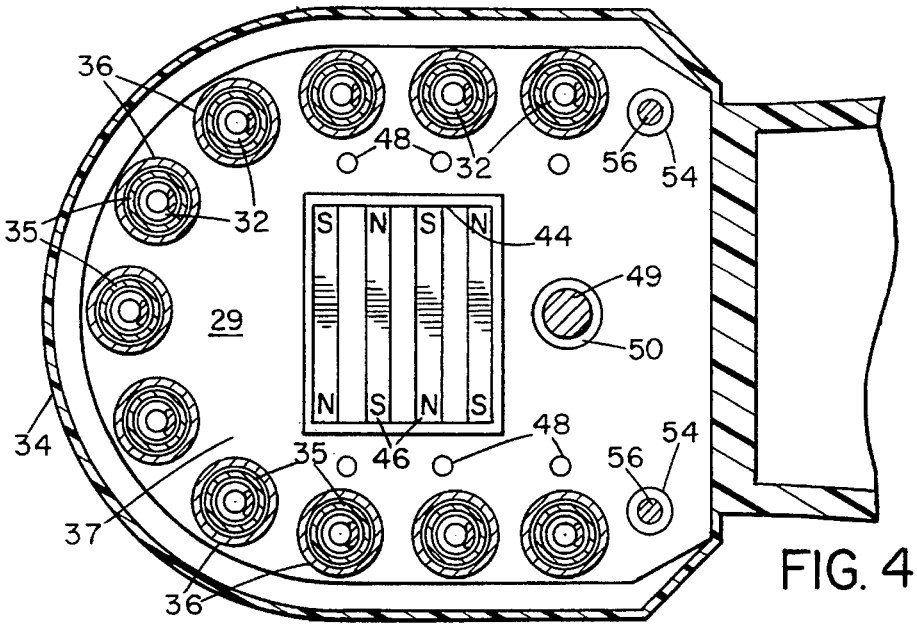
FIG. 4 is a cross-section on the lines 4—4 of FIG. 1.

As best illustrated in FIGS. 3 and 4, at least the heel region 20 of the sole 12 has an internal cavity 28 having an upper wall 29 and a lower wall 30, and a plurality of springs 32 are mounted at spaced intervals between the upper wall 29 and lower wall 30 around the rim 26 of the heel region. The cavity 28 preferably runs from the rear end of the heel towards the instep or arch region, terminating around 4 inches from the rear end of the heel in one example. An outer debris shield 34 of flexible bellows-like construction extends between the upper wall 29 and lower wall 30 of the heel around the outer periphery of the cavity, as illustrated in FIGS. 3 and 4. Preferably, each spring is mounted in a pair of opposing, telescopic canisters 35,36. Each spring is secured at one end in the first cylindrical canister 35 secured to the upper wall 29 and is mounted at the opposite end in the second cylindrical canister 36 secured to the lower wall 30. The second canister is of larger diameter than the first and has an open upper end which is in telescopic sliding engagement over the lower, open end of the first canister. Thus, the springs 32 are shielded and protected, and are also guided to compress and expand in a linear fashion. A small hole may be provided in one of each pair of canisters for relieving air pressure. Sliding O-ring type seals (not illustrated) may be provided between the overlapping or telescoping ends of the canisters to seal the interior of the canisters from dirt. In an alternative embodiment, the canisters 35,36 may be omitted and the springs may simply extend freely between the upper and lower walls.

The upper canisters 35 may be formed integrally with a one-piece upper insert member or plate 37, while the lower canisters are formed integrally with one piece lower insert member or plate 38, to form a two-part insert for securing in the heel cavity during manufacture. The upper insert member is suitably bonded or overmolded onto upper wall 29, while the lower insert member 38 is bonded or overmolded onto lower wall 30. The debris shield 34 may be formed integrally with the upper wall as a flat piece initially, and the upper and lower insert members can be installed through the gap between the upper and lower wall, compressing the springs and urging the upper and lower wall apart to allow the springs to be installed in the canisters. The debris shield 34 is then bent down over the gap between the upper and lower wall and suitably secured to the lower wall by bonding, overmolding or the like. Alternatively, the debris shield 34 may be formed as a separate piece which is suitably bonded or glued between the upper and lower wall of the heel region. The debris shield makes the heel cavity virtually impervious to debris and water. The shield 34 may be of a silicone-based aerogel material. The shield may be of transparent material to allow viewing of the shock absorbing insert inside the heel cavity.

Preferably, in addition to springs 32, opposing magnets 40,42 are installed in the central region of the upper and lower insert members, respectively, in order to urge the upper and lower insert members apart. The upper and lower insert members are provided with opposing rectangular recesses 44,45, respectively, for receiving the magnets, as illustrated in FIGS. 2–4. The magnets may each comprise a single rectangular plate-type magnet, but in the preferred embodiment each magnet 40,42 includes a plurality of spaced, parallel magnet strips 46, 47, respectively, oriented across the width of the heel. Each strip in a recess is positioned with its poles in the opposite direction to the or each adjacent strip in that recess, as illustrated in FIG. 4, and with its poles oriented in the same direction as the aligned strip of the opposing recess, as illustrated in FIG. 3. Thus, aligned strips are positioned with like poles opposing one another so that they are magnetically repelled from one another and tend to hold the cavity open.

In the embodiment illustrated in FIGS. 1–4, there are a total of 11 springs in canisters around the periphery of rim 26, and each magnet includes four spaced, parallel magnet strips. However, a greater or lesser number of springs may be provided in other embodiments, and a greater or lesser of magnet strips may be used if desired, depending on the wearer's weight and shoe size. The magnets are suitably bonded or adhesively secured in the respective recesses prior to installation of insert members into the split heel region of the sole. The magnets may be mounted on a non-magnetic backing plate for installation in the respective recess.

As best illustrated in FIGS. 2 and 3, the springs 32 are positioned outside the periphery of the heel region of the shoe upper 14, so that they will not be positioned directly under the heel of a wearer of the shoe. The enlarged heel area of the sole adds increased surface area for shock absorption at the heel of the shoe, which is the first region to strike the ground when walking and typically must absorb the maximum impact forces. The increased heel area also adds stability. Since the springs are not positioned directly under the heel, the risk of harmful shock or uncomfortable spring pressure points under the heel is avoided. Preferably, the rim 26 extends outwardly to a width of around ¼ inch to ⅝ inch beyond the outer periphery of upper heel periphery 16.

The springs and opposing magnets together act to absorb and dissipate shock and to urge the upper and lower walls of the cavity apart when downward pressure on the heel is released by the wearer lifting their heel. This adds lift and propulsion to the wearer's foot in motion. Preferably, the maximum air gap between the upper and lower heel insert members is of the order of ½ to ⅝ inch, and the springs and magnets are designed to allow a deflection of around ½±⅝ inch. As the wearer presses down on the heel, the springs and magnets first dissipate load or shock by allowing a deflection or compression of up to ½=⅝ inch. The springs and magnets cushion the load and never allow the cavity to be completely closed. Then, as the wearer rotates from the heel to the ball of the foot, the springs and magnets urge the opposing walls of the cavity apart as they return to their initial, unloaded position. This results in lift or propulsion to the shoe wearer as the load moves from the heel to the ball, and finally to the toe of the shoe, in a normal walking motion.

Figure 7:
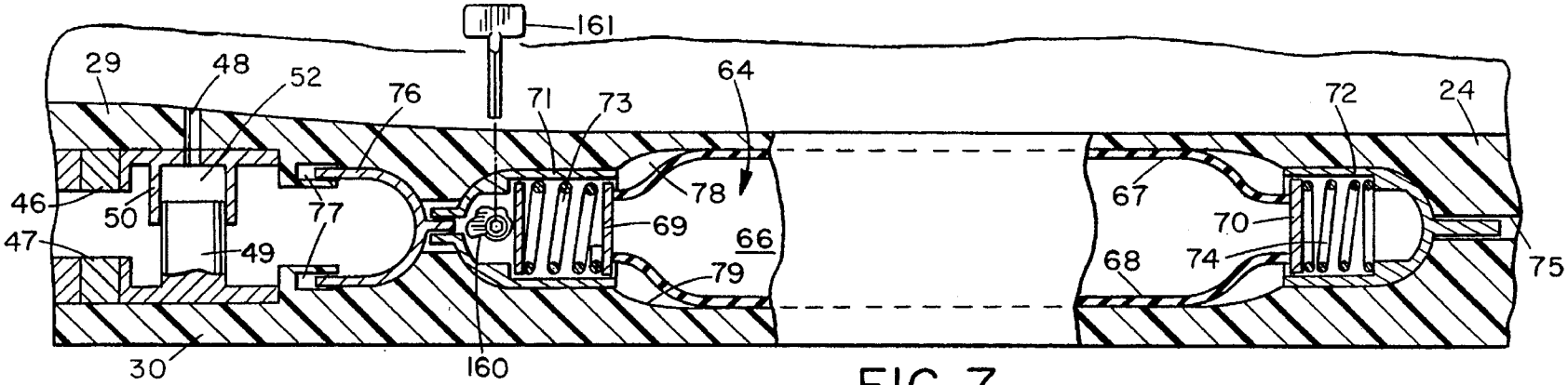
FIG. 7 is a longitudinal cross-section through the sole of the shoe on the lines 7—7 of FIG. 2, illustrating an optional insert assembly for the ball of the foot region.

Preferably, the upper wall 37 of the cavity 28 has aeration vents 48 which extend through the outsole and upper insole for air flow circulation inside the shoe uppers. This uses the increased air pressure in the cavity as the user strikes the ground with the heel of the shoe to force air upwardly through the vents 48. The wearer will push down the upper wall towards the lower wall of the heel as they walk, compressing springs 32 and moving the magnets closer together, forcing air out via vents 48. FIGS. 2 and 7 illustrate a modification for enhanced air flow into the upper 14. As best illustrated in FIG. 7, plunger 49 projects upwardly from the lower insert 38 of the outsole and slidably engages in the lower, open end of cylinder 50 projecting downwardly from upper insert 37. The interior of cylinder 50 forms an air chamber which is connected to one or more of the vents 48, as illustrated in FIG. 7. More than one pair of opposing plungers and cylinders may be provided. Thus, as the wearer presses down in the heel area, plunger 49 will be driven into cylinder 50 and will force air out along passageways 52 to the vents 48. The arrangement may be reversed with the plungers on the upper insert and the cylinders on the lower insert. This increased air circulation helps to control moisture inside the shoe.

In order to prevent the upper and lower heel inserts from being biassed too far away from one another on installation in the heel cavity, the insert members may be formed with integral snap lock fasteners, such as split sleeves 54 and telescopically engageable pins 56, respectively. These allow the cavity to be compressed since the pins are free to slide further into the sleeves, but restrict expansion of the cavity to the point at which the enlarged ends 57 of the pins reach the in-turned rims 58 of the sleeves.

The springs 32 are designed to handle approximately 2 to 5 times the wearer's body weight, and the designed spring load will be different for different size shoes and for different weight wearers. Shoes are preferably provided for varying weight individuals, for example adults from 100 lb to 250 lb at 15 lb increments. Thus, for a 200 lb man, the springs are designed for approximately 600 to 1,000 lbs load, so that with a total of 11 springs, each spring would be designed to maintain a cushion up to a maximum load of around 56 to 91 lbs (in other words so that they will not "go solid" or compress completely under loads up to around 91 lbs). In one example, each spring 32 for a 200 lb man was 1 inch in total length, approximately ½ inch outer diameter, and had 9⅔ total coils, 7⅔ active coils. In another example the spring outer diameter was ⅜ inch, and the spring length was 1¼ inch to 1⅜ inch (±⅛ inch). The springs may be of any suitable material, such as piano wire, zinc-coated metal, stainless steel, composite plastic or the like.

The springs may be adjustable by the user, for example, as illustrated in FIG. 3. A movable end plate 150 may be provided at the lower end of each spring, which is adjustable by means of turnkey 152 inserted through bore 154 to engage screw threaded member 155 to move plate 150 up and down and thus selectively increase or decrease spring tension.

The magnets or magnet strips are preferably high intensity magnets of the order of 35–43 MGO (magnetic gauss output). The magnets may be of any suitable high grade rare earth magnetic material such as rare earths, neodymium, atrium oxide, alnico, samarium cobalt, carbon black, graphite, bizmuth, bizmuth crystals, barium, strontium, magnetite, electrum, quartz crystals, piezoelectric crystals, ceramics, diamond, cubic zirconium, ferrite, copper alloys, copper oxides of yttrium, lanthanum, electrum, NdFeB or other combinations. The recessed areas in the upper and lower insert members preferably have dimensions of 2 inches by 1.5 inches, and a depth of the order of 0.185 inches. As noted above, plate-like rectangular magnets may be provided of equivalent dimensions for flush fitting in recesses. In the preferred embodiment, as illustrated in the drawings, magnet strips were used which had a length of around 2 inches and width of around 0.17 to 0.25 inches, with a thickness of around 0.185 inches, i.e. substantially equal to the depth of the recess, up to 0.25 inches. The total magnet weight is designed to be no more than 3.2 ounces per shoe. The magnet strips may be mounted on a single rectangular backing plate 156 or multiple backing plates of non-magnetic metal material.

The magnets may alternatively be mounted in recesses in the spring-mounting canisters. Magnets may optionally replace the springs as a perimeter biassing means.

Preferably, the magnets are magnetized during manufacture of the shoe, and not prior to installation in the sole insert members. One possible manufacturing process for installing the insert assembly of FIGS. 1–4 in a shoe sole will now be described. Preferably, the entire sole 12 is formed in two halves, an upper sole part and a lower sole part split along line 60 of FIG. 1. The upper and lower sole parts will be recessed in the heel region to form cavity 28 when the two parts are bonded or otherwise secured together. As mentioned above, the debris shield 34 may be formed integrally with the upper sole part as an initially flat extension of the sole part, or may be formed separately from the upper and lower sole parts.

Preferably, the upper outsole part is designed for attachment to the shoe uppers at a feather line by glue, stitching, sonic welding or the like. Alternatively, the upper outsole part may be molded integrally with the shoe upper, and an insole may also be molded integrally with the upper outsole part. In this case, the upper will be of the same material as the outsole, and joints may be formed more readily via T-joint member 15. Additionally, the outsole has an opening at the heel region through which heel cup 158 extends into an upper recessed area 159 of the upper insert part, forming a second feather line attachment. The recess for receiving the heel cup compensates for the height of the springs and the air gap, so that the shoe is not substantially higher at the heel than normal.

The upper and lower sole parts are first molded separately, and the upper and lower heel insert members are also formed separately by injection molding or the like. The upper and lower insert members are of much harder, more rigid material than the outsole. The outsole may be composite, plastic, polymer, copolymer, natural or synthetic rubber material or the like. In a preferred embodiment of the invention, the outsole material is a mixture of polybutadiene material (synthetic rubber) such as isoprene formulated for high resilience and light weight, substituting an aerogel as a filler material, and other materials. The insert members are of similar material but have a much higher strength than the outsole, for example a shore hardness of at least 90. The upper insert member is then suitably adhesively bonded or overmolded onto the recessed heel portion of the upper sole part, and the lower insert member is similarly secured to the recessed heel portion of the lower sole part. Alternatively, these members may be molded together with the upper and lower sole parts, respectively.

Non-magnetic metal slugs, which are initially non-magnetized, are pressed and bonded into the recessed regions of the upper and lower insert member, either prior to securing these members to the upper and lower sole parts, or after they have been bonded or molded to the upper and lower sole parts. The magnet slugs are then magnetized separately by means of a magnet saturation fixture or capacitor discharge machine of a known type. The magnet saturation fixture is of a conventional type used in magnet manufacture and suitably comprises a C-shaped yoke with magnetizing coils wound around the opposing ends of the yoke and separated by a field gap of a width designed to receive the heel portion of the upper or lower sole part. The magnets in the two sole parts are thus magnetized through the face separately by placing the heel portions successively in the field gap of the magnetizing fixture, and activating the fixture to saturate the magnet slugs. Alternatively, a multipole saturation process may be used, instead of a "through the face" magnetization as described above. The magnetizing polarity is switched for the lower sole part so that like magnet poles are in opposition when the upper and lower sole parts are secured together. By magnetizing the magnet slugs during manufacture, higher intensity magnets can be used in the insert. The magnets preferably have a 35 MGO or magnetic gauss output rating.

The springs are then inserted and secured in one of the canisters, and the two outsole parts are placed together so that the opposite ends of the springs extend into the opposing canisters, snapping closed the snap-lock pins and sleeves so as to prevent separation. The two outsole parts are then compression molded together to form an integral sole 12, and the debris shield 34 is secured between the two parts to seal the cavity 28. The outsole is then suitably fitted and attached to upper 14.

The debris shield 34, where formed separately from the outsole upper and lower parts, has a length of around 11 inches and a thickness of around ⅛–¼ inch, and is suitably molded to form bellows as illustrated in FIG. 3.

The insert members may be of any suitable moldable high strength, durable material such as polyethylene, thermoplastics, nylon, PVC, polycarbonates, and the like.

Although the cavity and insert is placed in the heel of the shoe, it may be positioned elsewhere in the shoe in alternative embodiments, or additional cavities and inserts may be provided in the sole, for example in the ball of the foot region 22 or the arch region 21. For example, as indicated in dotted outline in FIG. 1, an empty cavity 62 may be formed in the sole 12 to extend across most of the width of the sole in the ball of the foot region 22. This may be formed by making suitable recessed regions or grooves in the upper and lower sole parts in the manufacturing process described above, with the recesses opposing one another to form a cavity 62 when the two sole parts are secured together. Empty cavity 62 has a length of at least 1 inch.

In the preferred embodiment, however, a further insert assembly 64 is installed in the sole of the shoe to extend from the heel region up to the toe region 24, and across the width of the sole, as illustrated in FIG. 7. The insert assembly 64 is preferably centered in the ball of the foot region. It basically comprises a collapsible chamber 66 having an upper flexible wall 67 and a lower flexible wall 68 of composite material. The opposite ends of each wall are secured to end plates 69,70, respectively, which are located in the arch region and the toe region, respectively of sole 12. Each end plate 69,70 is slidably mounted in a respective C-shaped channel member 71,72, and is biassed by spring 73,74 respectively towards the open end of the channel member so as to bias the walls 67,68 to their maximum or fully open position as illustrated in FIG. 7. The channel member 72 at the toe end of the sole has a projecting tongue or flange 75 which is secured in the toe region of the sole. Channel member 71 is secured to an oppositely directed, C-shaped channel member 76 which in turn engages in slots 77 provided for that purpose in the upper and lower wall of the heel region of the sole. The upper and lower parts of the sole are provided with suitably shaped recesses 78,79 for forming a cavity to receive the insert assembly when the sole parts are bonded or overmolded together.

The tension in springs 73 and 74 may be adjustable by means of cam wheels or discs 160 rotatably mounted in each C-channel 71,72 between the inner end of the channel and the respective spring. A turnkey 161 is provided for engaging a hex bore in the center of disc 160 so as to rotate the disc 160 and selectively increase or decrease the spring tension.

With this arrangement, when the wearer transfers weight from the heel to the ball region and toe of the shoe while running or walking, cavity 64 will be compressed, and end plates 69,70 will be pushed outwardly in their respective channel members 71,72, compressing the springs 73 and 74. When weight is released as the foot is lifted, springs 73 and 74 will expand and at the same time push walls 67 and 68 outwardly, providing added lift. Cavity 64 is preferably centered in the ball of the foot region, and extends across the entire width of the sole except for a thin outer wall or debris shield on opposite side edges of the sole for sealing the cavity.

Figure 5:
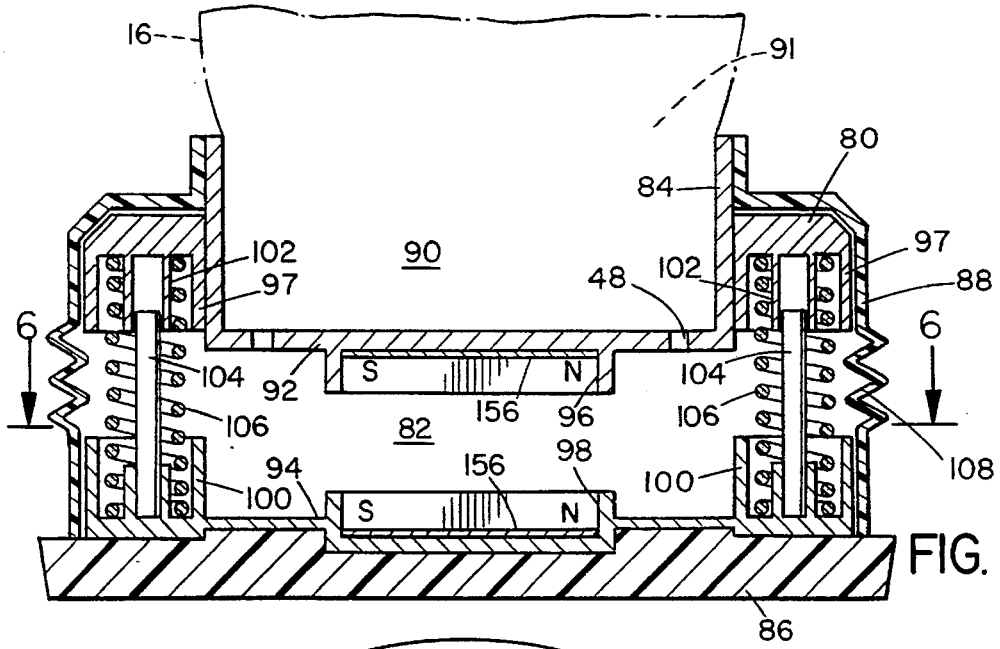
FIG. 5 is a cross-section similar to FIG. 3 illustrating an insert assembly according to another embodiment of the invention.
Figure 6:
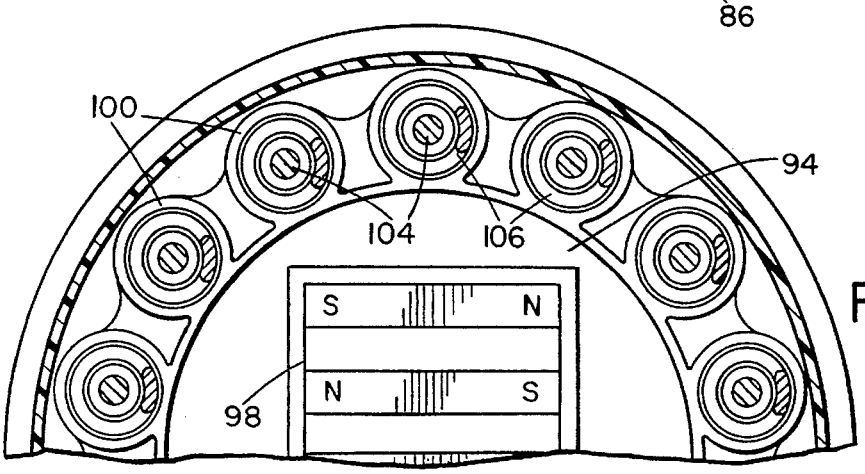
FIG. 6 is a partial cross-section on the lines 6—6 of FIG. 5.

FIGS. 5 and 6 illustrate a heel insert assembly according to another embodiment of the invention. As in the previous embodiment, the sole of the shoe has an enlarged rim 80 in the heel region which projects outside the heel region 16 of the shoe upper 14. The sole has an internal cavity or air gap 82 of equivalent dimensions to the previous embodiment between the upper wall or part 84 of the sole and the lower wall or part 86 of the sole, while a flexible debris shield 88 extends between the upper and lower parts 84,86 of the sole to seal and protect the cavity. The upper part 84 of the sole has a recessed region 90 for receiving a heel cup or heel upper 91 secured to upper 14, as illustrated in FIG. 5. An upper insert member 92 is secured to the upper wall of the sole, while lower insert member 94 is secured to the lower wall 86. Aeration ports 48 extend through upper insert member 92 and heel cup 91 into the upper, as in the first embodiment.

Upper insert member 92 has a generally flat central portion with a rectangular, downwardly facing recess 96 equivalent to recess 44 in the previous embodiment for receiving magnet strips 46 as in the previous embodiment. By providing recesses for mounting the magnet strips such that the outer faces of the magnet strips are flush with the outer face of the recesses or recessed slightly inwardly, potential impact and resultant damage between the opposing magnet faces is prevented. The thickening of the outsole upper piece or wall in the region above the magnets will prevent development of a hard spot in the heel area due to repeated pressure against the magnets.

A plurality of spaced, downwardly facing tubular bosses or canisters 97 extend around the periphery of central portion to follow the periphery of the heel region of the shoe, in a similar fashion to canisters 35 of the previous embodiment. Lower insert member 94 has a central portion with a rectangular, upwardly facing recess 98 opposing recess 96 for receiving magnet strips 47 as in the previous embodiment, as illustrated in FIG. 6. A plurality of spaced, upwardly facing tubular bosses or canisters 100 extend around the periphery of insert 94 in alignment with downwardly facing bosses 97. Downwardly facing bosses 97 each have a central tubular portion or sleeve 102 and upwardly facing bosses 100 have an upwardly projecting post or peg 104 which is slidably engaged in sleeve 102 for alignment purposes. A spring 106 extends between each pair of opposing bosses. Each spring 106 is secured at one end to the inner end of boss 97 with its windings encircling inner sleeve 102, and is secured at the opposite end to the inner end of boss 100, so that the post 104 provides alignment for the spring which encircles it as the springs are repeatedly compressed and expanded.

Debris shield 88 may be formed separately or may be formed integrally with either the lower wall 86 or upper wall 88. As best illustrated in FIG. 5, the shield 88 comprises a relatively thin strip of resilient material with a series of longitudinal grooves 108 extending along its length. The shield may be formed as a flap projecting outwardly from lower wall 86 and then may be bent upwardly around the upper insert member, and may be suitably secured to the upper wall 84 around recess 90 by rivets, bonding or the like. The grooves 108 may be confined to the height of cavity 82 instead of extending the full height of the heel as illustrated in FIG. 5. The shield will be around 11 inches long, 2–3 inches wide, and have a thickness of around ⅛–¼ inch.

The insert assembly of FIGS. 5 and 6 may be installed in the heel of a shoe sole with no other inserts, or it may be used in conjunction with a simple empty cavity in the ball of the foot region as in FIG. 1, or in conjunction with the extended insert assembly 64 as illustrated in FIG. 7. It will operate in a similar fashion to cushion and absorb shock as the wearer pushes down at the heel, compressing springs and moving opposing magnet strips 46,47 closer together. Thus, when pressure is released, the springs will expand and the magnet strips will be biassed apart, the springs and magnets together providing enhanced lift as the wearer walks or runs. The recess 90 has a depth of approximately ⅝ to 1½ inch to compensate for the spring height.

The shoe upper 14 may be attached to the sole 12 of either of the above two embodiments by any conventional means, such as gluing, stitching, sonic welding or other types of attachment. Alternatively, the upper may be integrally molded with the sole or outsole. Any desired tread pattern may be provided on the bottom surface of the sole 12. A heel guard may be provided if the sole utilizes a built up heel, rather than a generally flat bottomed heel as in FIG. 1. The heel guard will be molded with the outsole and will run across the bottom of the outsole at a location approximately one inch from the front of the heel. The heel guard will comprise a rib of height approximately ¾ of the total heel height and will be approximately ¼ to ½ inch wide.

In each of the above embodiments, additives such as aluminum or stainless steel flakes and other insulative non-conductive materials may be provided in the material/design of both the outsole and the insert members. This will provide EMI (electromagnetic interference), RFI (radio frequency interference) shielding, dB shielding, as well as Guns/Flux shielding.

Figure 8:
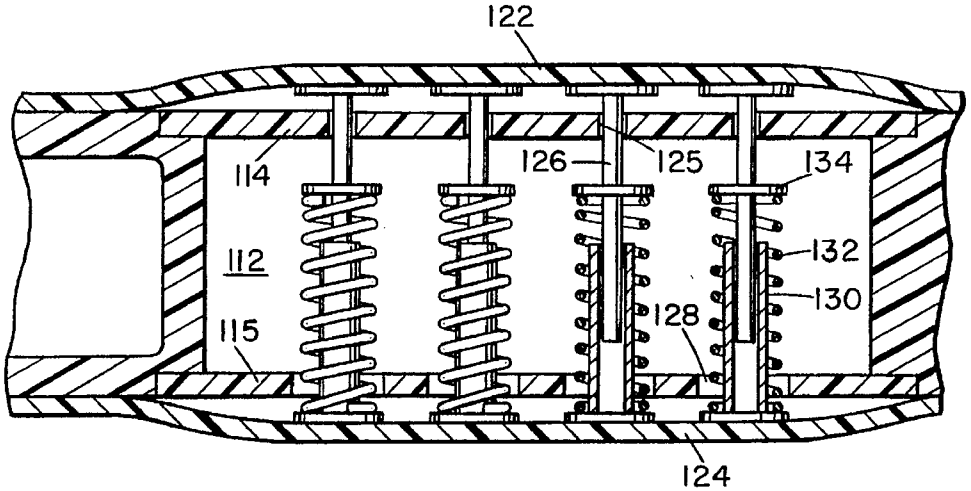
FIG. 8 is a cross-sectional view similar to FIG. 3 illustrating an alternative insert assembly.

FIG. 8 illustrates another alternative sole insert assembly 110 which may be installed in the heel or ball of the foot region. As illustrated in FIG. 8, insert assembly 110 replaces insert assembly 64 centered on the ball of the foot region in FIG. 7. The sole of the shoe has an internal cavity 112 extending from the arch to the toe and across the width of the shoe. A pair of alignment plates 114,115 extend lengthwise along cavity 112. A gap 116 is provided between the upper alignment plate 114 and upper floating wall 118 of the cavity, and a similar gap 119 is provided between lower alignment plate 115 and the lower floating wall 120 of the cavity. The upper alignment plate 114 has a series of openings 125 through which spaced posts 126 secured to wall 122 project downwardly. The lower alignment plate 115 has a series of larger openings 128 aligned with openings 125 in the upper plate. A series of tubular sleeves 130 project upwardly from wall 124 through openings 128, and the lower ends of posts 126 are slidably engaged in respective sleeves 130. A spring 132 is mounted on each of the sleeves 130 and extends between panel 124 and a stop collar 134 on the respective post 126. Thus, spring 132 biasses the two floating panels or walls apart.

When the wearer of the shoe pushes downwardly against the upper wall 118 of the cavity, the wall will be pushed downwardly, compressing springs 132 to absorb shock. When pressure is released, the springs will expand to push wall 118 back upwardly, providing lift.

Figure 9:
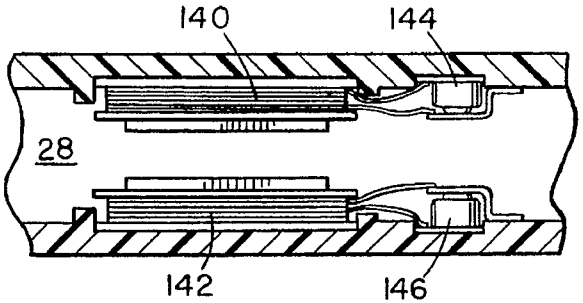
FIG. 9 is a partial cross section through part of an insert assembly illustrating a modified magnet configuration.

FIG. 9 illustrates an optional modification in which the magnets 40,42 of the previous embodiments are replaced or augmented by electromagnets 140,142 mounted in the upper and lower wall of the cavity 28 as illustrated. The springs have been omitted in FIG. 9 for clarity. Each of the electromagnets coils is connected to a battery source 144,146 or a micro circuit/chip power source and may be pre-charged. The batteries or other power source may be embedded at an appropriate location in the outsole. Preferably, the batteries are designed to be switched on automatically via pressure transducers or the like when a wearer dons the footwear, and will be off to save power when the footwear is not being worn. This arrangement will provide an increased magnetic biassing force for both absorbing shocks and providing lift.

In all of the above embodiments, a cavity or gap in the outsole of the footwear is designed to stay open under all conditions, including when the wearer of the footwear bears downwardly on the sole while walking or running. Biassing means such as springs alone or springs in conjunction with magnetically opposing magnets act to bias the cavity into its fully open condition, such that after the wearer has pressed down against the sole and releases pressure, lift will be provided to the wearer's foot by the springs and magnets. Thus, both cushioning against shock on impact with the ground, and lift in moving the foot away from the ground, are provided by means of the insert assembly of this invention.

Although some preferred embodiments of the invention have been described above by way of example only, it will be understood by those skilled in the field that modifications may be made to the disclosed embodiments without departing from the scope of the invention, which is defined by the appended claims.

I claim:

1. An article of footwear, comprising:

an upper shaped to conform to the upper contour of a wearer's foot and including a heel portion for conforming to the wearer's heel;

an outsole member attached to the upper for supporting the sole of a wearer's foot, the outsole member having a heel region, an arch region and a toe region;

the heel region of the outsole member having a rim portion projecting outwardly around the periphery of the heel portion of the upper;

the outsole member having a cavity extending across at least the heel region; the cavity having an upper wall and a lower wall;

biasing means mounted between the upper and lower wall of the cavity around the projecting rim portion of the heel region for biasing said upper and lower wall apart;

at least one upper magnet secured to the upper wall of the cavity in a region beneath the heel portion of the upper, and at least one lower magnet facing the upper magnet and secured to the lower wall of the cavity, the magnets being oriented with like poles facing one another so that there is a magnetic repulsion force between the magnets; and a plurality of spaced, parallel magnet configurations secured, respectively, to the upper and lower wall of the cavity, each strip on the upper wall being aligned with a corresponding strip on the lower wall, each strip on the upper wall being positioned with its poles oriented in the opposite direction to each adjacent strip, and each strip on the upper wall having its poles oriented in the same direction as the aligned strip on the lower wall.

2. The article as claimed in claim 1, including a plurality of downwardly directed canisters projecting downwardly from the upper wall at spaced intervals around the rim region, and a plurality of upwardly directed canisters projecting upwardly from the lower wall at correspondingly spaced intervals so that the upwardly and downwardly directed canisters are aligned in pairs, each pair of canisters being in telescopic sliding engagement to define a chamber, and each spring being mounted in a respective canister chamber.

3. The article as claimed in claim 1, including a plurality of downwardly directed canisters projecting downwardly from the upper wall at spaced intervals around the rim region, and a plurality of upwardly directed canisters projecting upwardly from the lower wall at correspondingly spaced intervals so that the upwardly and downwardly directed canisters are aligned in pairs, each pair of canisters being spaced apart and each spring being secured at opposite ends in a respective canister.

4. The article as claimed in claim 1, including a flexible debris shield extending between the upper and lower wall of the cavity around the periphery of said rim region.

5. The article as claimed in claim 4, wherein the debris shield has horizontally extending ribs and grooves forming a bellows-like collapsible member.

6. The article as claimed in claimed 4, wherein the debris shield is formed integrally with the outsole member.

7. The article as claimed in claim 1, including a plurality of aeration vents in said upper wall for air flow into the upper.

8. The article as claimed in claim 1, wherein the outsole has at least one additional cavity extending across at least the ball of the foot region of the outsole member.

9. The article as claimed in claim 8, wherein the cavity is an empty cavity.

10. The article as claimed in claim 8, wherein the additional cavity extends across the width of the outsole member and extends from the arch region towards the toe region of the outsole.

11. The article as claimed in claim 10, including a collapsible chamber within said additional cavity, the chamber having an upper resilient wall and a spaced, lower resilient wall, and biassing means for biassing said resilient walls away from one another.

12. The article as claimed in claim 1, wherein the outsole member comprises in two halves split longitudinally along the length of the article of footwear, the halves being secured together, and the halves being recessed in said heel region to form said cavity when the halves are secured together.

13. The article as claimed in claim 12, wherein the upper is integral with the upper half of the outsole member.

14. The article as claimed in claim 13, including an insole molded integrally with the upper half of the outsole member.

15. The article as claimed in claim 1, wherein the outsole comprises a synthetic polybutadiene material and an aerogel filler.

16. An article of footwear, comprising:

an upper shaped to conform to the upper contour of a wearer's foot and including a heel portion for conforming to the wearer's heel;

an outsole member attached to the upper for supporting the sole of a wearer's foot, the outsole member having a heel region, an arch region and a toe region;

the heel region of the outsole member having a rim portion projecting outwardly around the periphery of the heel portion of the upper;

the outsole member having a cavity extending across at least the heel region, the cavity having an upper wall and a lower wall; and biasing means mounted between the upper and lower wall of the cavity around the projecting rim portion of the heel region for biasing said upper and lower wall apart;

biasing means comprises a plurality of springs mounted at spaced intervals around said projecting rim portion including an upper insert member secured to the upper wall of the cavity and a lower insert member secured to the lower wall of the cavity, the upper insert member having a series of integrally formed, downwardly directed spring mounting bores for receiving one end of each of the springs and the lower insert member having a series of integrally formed, upwardly directed spring mounting bores for receiving the opposite end of each of the springs;

wherein the upper insert member has a central region having a rectangular, magnet mounting recess and the lower insert member has an aligned central region with a corresponding magnet mounting recess, a pair of magnetically opposing magnets being mounted in the respective mounting recesses.

17. The article as claimed in claim 16, wherein each magnet has a backing plate of non-magnetic material.

18. An article of footwear, comprising:

an upper shaped to conform to the contour of the upper regions of a wearer's foot;

an outsole for securing to the upper to support the sole of a wearer's foot, the outsole having an outer periphery following the general contour of a foot and having a heel region, an arch region, a ball of the foot region add a toe region;

at least the heel region of the outsole being split to form a cavity of selected height extending from the outer periphery of the heel region of the outsole towards the arch region of the outsole, the cavity having an upper wall and a lower wall;

a plurality offsprings extending between the upper and lower wall at spaced intervals around the periphery of the heel region; and at least one upper magnet mounted on the upper wall and at least one lower magnet mounted on the lower wall facing the upper magnet, the magnets being oriented with like poles opposing one another so that they are magnetically biased away from one another;

whereby said upper wall is pushed downwardly towards said lower wall against the biasing force of said magnets and springs when a wearer presses down on the heel, and the upper wall is biased away from the lower wall by said magnets and springs when pressure is released;

wherein the magnets are electromagnets.

19. The article as claimed in claim 18, including a flexible debris shield extending between the upper and lower wall around the periphery of the split heel region to seal the cavity.

20. The article as claimed in claim 18, wherein said heel region has a peripheral rim projecting outside the periphery of said upper, and said springs are located around said peripheral rim.

21. The article as claimed in claim 18, including snap lock fastener means in said cavity for adjustably securing the upper wall to the lower wall to resist biassing of said upper wall away from said lower wall by a distance greater than said selected cavity height.

22. The article as claimed in claim 18, wherein said outsole has an empty cavity in the ball of the foot region.

23. The article as claimed in claim 18, wherein said cavity height is between ½ inch and ⅝ inch.

* * * * *